United States Patent [19]

Ishikawa et al.

[11] Patent Number: 4,689,598

[45] Date of Patent: Aug. 25, 1987

[54] ELECTRICAL FUSE

[75] Inventors: Hiroshi Ishikawa; Kiyohisa Yoshigae, both of Kawasaki, Japan

[73] Assignee: Fuji Electric Co., Ltd., Kawasaki, Japan

[21] Appl. No.: 930,152

[22] Filed: Nov. 12, 1986

[30] Foreign Application Priority Data

Nov. 15, 1985 [JP] Japan ..... 60-256202

[51] Int. Cl.[4] ..... H01H 85/04

[52] U.S. Cl. ..... 337/295; 337/159

[58] Field of Search ..... 337/295, 290, 159, 296, 337/160

[56] References Cited

U.S. PATENT DOCUMENTS 4,123,738 10/1978 Huber ..... 337/295

*Primary Examiner*—Harold Broome

*Attorney, Agent, or Firm*—Bruce L. Birchard

[57] ABSTRACT

An electrical fuse having an element which includes a strip of conductive metal connectable to the fuse terminals, the strip of conductive material having a plurality of holes through its thickness dimension spaced along the center line of its width, successive ones of the holes through the strip each having a slot joining that hole with an opposite one of the edges from the edge joined by the adjacent hole and its associated slot, the spacing of the holes and their associated slots being such that the current flowing through the fuse element is forced to zig-zag through regions which constrict the current and successive regions which have broad area and volume so that undesired abnormally high temperature rises within the fusing element, which might arise with ordinary over-loads which are not destructive and would cause unnecessary opening of the fuse element, are prevented, while, at the same time, the sensitivity of the fuse element to destructive current surges is retained and, if necessary, fusing time in low current regions of operation is enhanced by plating on the surface of the conductive strip a metal of low-melting-point which will form a eutectic with the base material of the strip to reduce the melting temperature of the fuse strip when it is operating in the low current regions and faces a sudden and destructive surge of electrical current, the combination having mechanical strength as well as improved electrical characteristics.

8 Claims, 4 Drawing Figures

ELECTRICAL FUSE

BACKGROUND OF THE INVENTION

1. Field of the Invention

This invention relates to elements for protecting electrical circuits and, more particularly, to a fuse element having a fusing characteristic which is controlled to give maximum protection from destructive currents without unnecessarily responding to safe overload current.

2. Prior Art

Fuses, or the fusing elements in the fuses, commonly found in electrical circuits have varying fusing times versus current levels, as can be seen in the curves of FIG. 1. In FIG. 1, Curve A shows the fusing time versus current for a fusing element of medium width. Curve B shows the fusing time versus current for a wide fuse element and Curve C shows a fusing time versus current for a fusing element having a constricted section. As can be seen in FIG. 1, a fuse opening time for the narrow width uniform strip-like element b-1 falls off dramatically in the high current region I. In the low-current region II the fuse opening time for the broad-width, uniform, strip-like fusing element b-2 rises marketedly. The fusing element b-3, having a constricted portion of length L, has a fusing time-current characteristic which overlaps the characteristics of elements b-1 and b-2. A short fusing time is desirable for destructive surges of current whereas a longer fusing time is required in connection with tolerable over-loads. It is not desirable to disconnect the load from the power supply for minor over-load conditions since it interrupts the operation of the equipment and may be destructive. Thus we have the inconsistent and contradictory requirements of avoidance of unnecessary fusing in the simple over-load state while at the same time requiring rapid fuse opening upon the flow of a destructively large current surge.

Furthermore, since the restricted portion such as that shown as b-3 in FIG. 1 has to withstand the potential appearing across the fuse terminals after fuse opening has occurred there is a minimum length L for the restricted region b-3.

In the past the problem of heat dissipation to prevent unnecessary fuse opening was accomplished by inserting the broad portions X and Y of the fusing element 10 in FIG. 1 into a heat dissipating member made of heat resistant ceramic and bonding the fusing element and the ceramic holder together by means of adhesives. However, such a structure has the drawback that it is large and, because the heat-dissipation member is made of ceramic the manufacturing cost is high. Because of the size of such a structure it is not freely usable in environments such as vehicles. There large acceleration forces may be experienced as a result of mechanical vibrations with the result that there is a separation between the fusing element and its ceramic support, thereby mechanically destroying the fuse.

Other efforts have been made to increase the heat dissipation in the fusing element by using a low melting point alloy which is applied to the broad-width portion of element 10, or a thick layer of low melting point alloy is formed between two sheets of metal. With this approach it is intended that the fusing time will be increased by increasing the surface or the volume of the broad-width portion of element 10. The increase in fusing time is particularly desirable at the boundary between the low current region II and the medium current region III to prevent the fusing time at a low current region from being increased. Looking at that another way, the fusing time is long in the low current region I. An eutectic alloy is formed between the low melting point metal and the other material which lies on both sides of that low melting point metal, thereby preventing an increase in the fuse opening time which might result were it not for a lower melting point of the eutectic alloy. At the boundary between the low current region I and the medium current region III, since the fuse opening time is relatively short, the eutectic alloy does not effectively increase the fuse opening time. However, the combination does avoid unnecessary fuse opening during over-load operation. With this combination, however, the material costs are high and the fabrication costs are high. Further, since weight has been added to the fusing element, that element may possibly be destroyed mechanically by any large force applied to the junction between the fusing element and the fuse terminals.

Therefore, it is an object of this invention to overcome the various disadvantages of the prior art devices.

It is a further object of this invention to provide a fuse with improved fusing characteristics and improved mechanical properties.

SUMMARY OF THE INVENTION

According to the present invention, a fuse is provided which is rapidly responsive to destructive current flow but does not open in response to simple over-load conditions which are not destructive of the load itself. Essentially the operating range of the fuse without opening is broadened by reason of the present invention. The present invention comprises a strip-like element having a constricted region on the opposite sides of which in the longitudinal direction of the element there is a plurality of holes which pass through the strip, with successive holes having openings communicating with opposite edges of the strip by way of recesses the lateral size of which is smaller than the diameter of the hole, whereby short constricted portions are distributed in the longitudinal direction and alternately on the two edges of the strip comprising the fusing element, whereby the electrical current is caused to pass through the constricted portions and the broader strip portions which are formed between each of the hoels, and the current zig zags through the fusing element, distributing heat generated in each of the current-constricting portions, the heat being directly dissipated in the broader strip portions to limit the temperature rise in the current constricting portions, thereby avoiding unnecessary fuse opening in a simple over-load region while providing fusing protection in the event of destructive current flow, without the adding of any particular substances to improve heat dissipation or heat conduction effects.

BRIEF DESCRIPTION OF THE DRAWINGS

This invention can best be understood by reading the description set forth herein in conjunction with the annexed drawings, in which.

DETAILED DESCRIPTION OF THE PREFERRED EMBODIMENT

Figure 1:
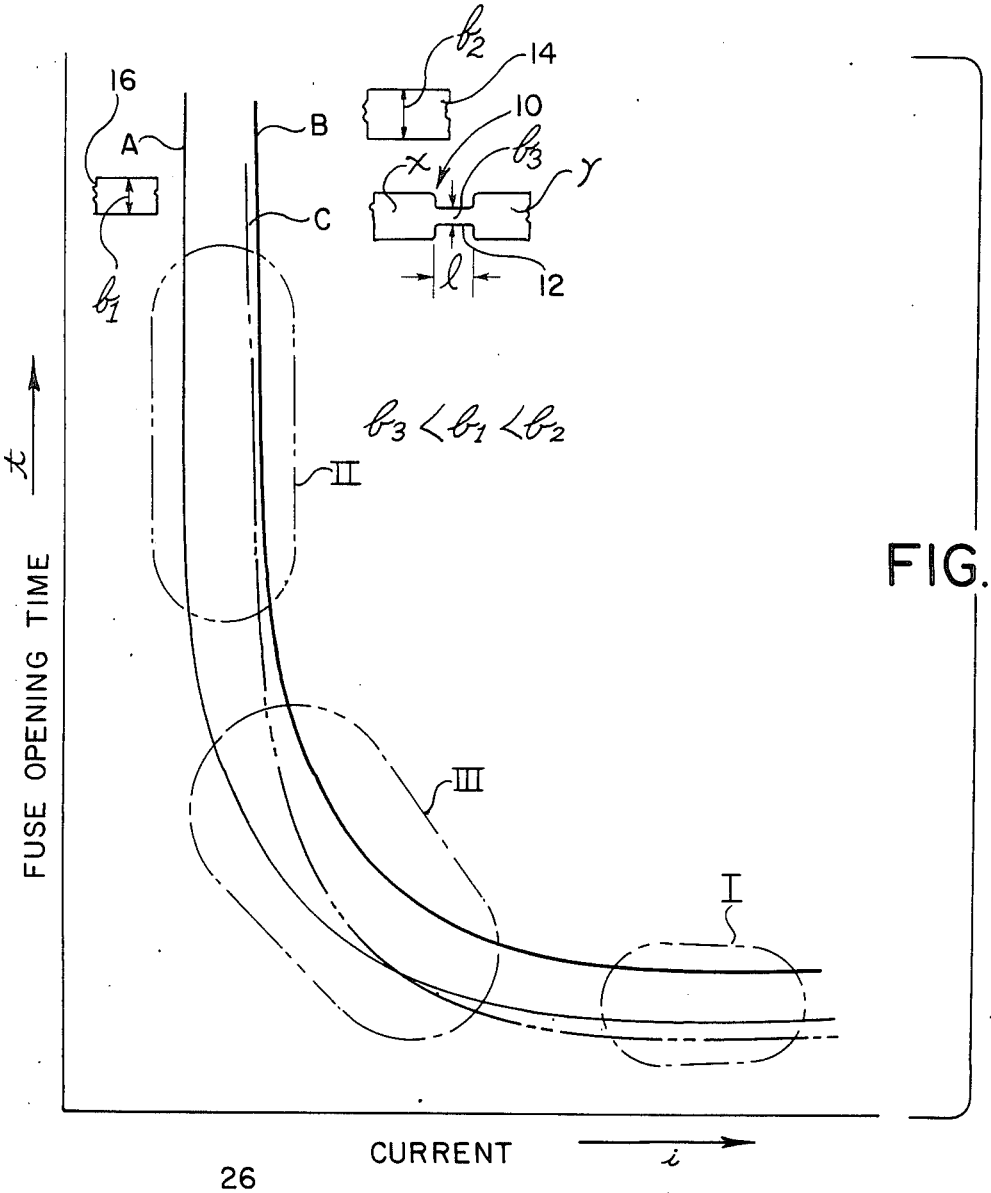
FIG. 1 is a graphical representation of the relationship between current flow and fuse opening time for various fusing element configurations.

In FIG. 1 there is set forth the relationship between fusing or fuse opening time and current for various configurations of a fusing element. In FIG. 1 fusing element 10 has two flat, relatively wide strip portions X and Y in a central reduced-width section 12 which has the effect of constricting current flowing from braod elements X and Y towards an electrical load, not shown. As can be seen from Curve C which represents the relationship between fuse opening time and current flowing through element 10, the fuse opening time decreases rapidly as the current being handled increases. In the low current handling region represented by II in FIG. 1, fuse opening time is significantly increasing with the reduction of current. This is an undesirable characteristic if a destructive current beings flowing to the load. The problem with having the fuse opening time decrease significantly with current is that with non-destructive increases in load current there is a tendency for the fuse to open prematurely forcing the use of the equipment to replace the fuse before he can continue operating. This characteristic is very pronounced for the configuraion of element 10 but it is equally undesirable for the configurations of elements 14 and 16. Element 14 is a wide-strip fusing element and element 16 represents a narrow-strip fusing element. The curves of FIG. 1 do indicate that changing the configuration, as by including the constricting region 12, can cause a significant change in the fuse opening time versus current carrying characterics of the fusing element. In the high current region I of FIG. 1 the temperature rise which occurs in a constricted region 12 of fusing element 10 is very high and the heat dissipation and heat conduction from segments X and Y of element 10 are not sufficient to offset the significant rise in temperature of the constricted section as a result of which premature fuse opening may occur. However, in the medium current region III the fuse opening time is grealy dependent on the heat dissipation of heat conduction affects from the X and Y portions of element 10. A mathematical analysis of that configuration shows that to avoid unnecessary fuse opening when mere tolerable overloads occur on the external circuitry the cross-section of constricted portion 12 should be as large as possible. At the same time, that cross-section should be as small as possible to assure that when a current surge that is destructive in nature comes along, fuse element 10 will open rapidly. There is a further criterion and that is that the constricted portion 12 has to withstand the voltage developed across the fuse terminals to which element 10 is connected and therefore there is a lower limit to the length L of the constricted portion.

To further assure that there is no unnecessary fuse opening, broad portions X and Y must have good heat dissipation capability. As a result, it is desirable to increase the surface area of the broad portions X and Y as well as to enlarge the volume of those sections to assure an increase in the time of fusing when ordinary overloads of the circuit occur. Normally the fusing element 10 would be made of a noble metal such as silver, or the like, and an increase in the surface area of the broad section and the volume thereof would result in the use of greater quantity of expensive material, thus making the fuse element itself expensive. In the prior art this problem has been met by providing heat resistant ceramic terminals for fusing element 10.

Figure 2A:
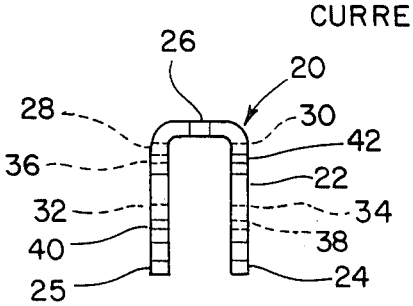
FIG. 2A is an elevational view of a fusing element for a fuse according to the present invention.
Figure 2B:
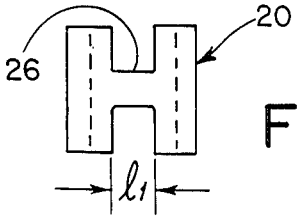
FIG. 2B is a plan view of the fusing element of FIG. 2A.

In FIG. 2A, fuse 20 has fuse element portion 22 which terminates at its extremes in terminals 24 and 25. Midway in fuse element 22 is the portion 26 of reduced width, the purpose of which is to constrict current flow. This element may be seen in FIG. 2B as well as in FIG. 2A. Holes 28, 30, 32 and 34, which can be seen more clearly in FIG. 3 pass through fusing element 22 and are successively open to the alternate edges of fusing element 22 by way of slots 36 and 38, for example. These slots appear more clearly in FIG. 3.

Figure 3:
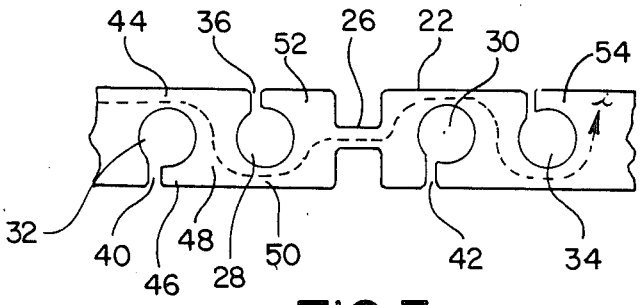
FIG. 3 is an enlarged, schematic view of a portion of the fusing element of FIGS. 2A and 2B.

In FIG. 3 the relationship of the holes, slots and regions of reduced width may be seen quite clearly. As can be seen, holes 28 and 32 pass through fusing element 22 and have respective slots 36 and 40 communicating with opposite edges of fusing element 22. It is to be noted that the width of slots 36 and 40 is less than the diameter of their respective associated holes 28 and 32. As can be seen from FIG. 3 this configuration results in regions which constrict the current, such as regions 44 and 50 joined by broad-width portion 48, thus causing the electrical current i to flow in a zig-zag manner when flowing from constricted region 44 through broad region 48 into constricted region 50, and thereafter through corresponding elements on the opposite branch of fusing element 22. With this structure there is a plurality of sets of constricted portions and broad-width portions which are connected in series, electrically, and the heat generated in each of the constricted portions 44, 50 and the like is dissipated in the broad-width portions 48 and 52. Since, in a fuse element, it is necessary only to provide a length of fusing element which is capable of withstanding the voltage appearing between the fuse terminals 24 and 25, the effective length of the individual constricted portions 44, 50 and following in the direction of flow of the current, may be made physically short and accordingly the amount of heat generated in the constricted portions is decreased markedly compared with the structure of the prior art, such as that as shown in FIG. 1 as element 10. Since the heat generated in the successive constricted portions, such as portions 22 and 50, is dissipated in the associated broad-width portions directly contiguous therewith, and from a specific dissipation portion 46 which operates at a lower temperature because current does not flow through it at all, heat is effectively dissipated in the fusing element 22 thereby enabling that element to suppress undesired temperature rise in the element in ordinary over-loading conditions thus avoiding unnecessary fuse openings.

There is a further advantage which is mechanical in nature. That is that the cycles of expansion and contraction which occur is a result of the rise and fall of the temperature in element 22 accompanying the change in the electrical load on the circuit can be partially absorbed because of the slots, such as slots 36 and 40, which act as a buffering mechanism to permit some warpage of the fusing element 22 without tearing it loose from the terminals 24, 25.

The structure of FIG. 3 not only increases the fuse opening time in the over-load current condition but it also increases the fuse opening time in the low current region of operation. This may be considered undesirable since if a surge occurs the opening time will be longer than is desired. This problem can be eliminated according to the present invention by plating on the element of FIG. 3 a low melting-point alloy which, when an abnormal current flows through the fusing element, melts in the low current region and forms a eutectic alloy. Since the fuse opening time is long in the low current region, the formation of the eutectic alloy will result in the lowering of the fusing time. This plating technique reduces the manufacturing cost as well as providing the desired fusing characteristic in the low current region of operation of fuse 20, without decreasing the mechanical strength of fuse element 22. It is apparent that constricted region 26 in fusing element 22 may be replaced by one of a series of constricted regions 44, 50, thus eliminating the need for the constricted region 26. The fabrication of fusing element 22 is thus simplified.

While a particular embodiment has been shown and described it will be apparent to those ordinarily skilled in the art that alterations and modifications may be made in the embodiment shown without departing from the spirit and scope of this invention. It is the purpose of the appended claims to cover all such alterations and modifications.

What is claimed is:

1. An electircal fuse element including a strip of conductive material having opposite edges and having a predetermined co-efficient of resistivity and a predetermined melting point, said strip having a width dimension between said opposite edges, a thickness dimension and a length dimension;

said strip having a plurality of holes through its thickness in the direction of said thickness dimension and spaced along said length dimension of said strip substantially midway between said opposite edges, successive ones of said holes each having a slot joining that respective hole to an opposite one of said opposite edges from the adjacent one of said holes.

2. A device according to claim 1 including, in addition, connecting means for connecting said electrical fuse element to an electrical circuit.

3. A device according to claim 1 in which said strip includes, in addition, a rectangularly-shaped current-constriction portion.

4. A device according to claim 1 in which said strip of conductive material carries a plated layer of low-melting-point metal.

5. A device according to claim 2 in which said connecting means is a pair of terminals of electrically conductive, high-melting-point metal.

6. A device according to claim 1 in which said holes through said strip are closely spaced so as to form a zig-zag current path through said strip.

7. A device according to claim 1 in which said conductive material of said strip is a low-melting-point metal.

8. A device according to claim 1 in which said conductive material of said strip is of an alloy including silver.

* * * * *